US009044932B2

(12) United States Patent
Ohnishi et al.

(10) Patent No.: US 9,044,932 B2
(45) Date of Patent: Jun. 2, 2015

(54) IMAGE RECORDING METHOD

(71) Applicant: CANON KABUSHIKI KAISHA, Tokyo (JP)

(72) Inventors: Toru Ohnishi, Yokohama (JP); Minoru Nozawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/195,686

(22) Filed: Mar. 3, 2014

(65) Prior Publication Data

US 2014/0247302 A1 Sep. 4, 2014

(30) Foreign Application Priority Data

Mar. 4, 2013 (JP) ..... 2013-041964

(51) Int. Cl.
*B41J 2/01* (2006.01)
*B41J 2/005* (2006.01)

(52) U.S. Cl.
CPC *B41J 2/0057* (2013.01); *B41J 2/01* (2013.01); *B41J 2002/012* (2013.01)

(58) Field of Classification Search
CPC .... B41J 2/2114; B41J 2/0057; B41J 11/0015; B41M 7/0027; B41M 5/025; B41M 7/00
USPC ..... 347/21, 95, 96, 100, 103
See application file for complete search history.

(56) References Cited

U.S. PATENT DOCUMENTS

2013/0342622 A1* 12/2013 Imai et al. ..... 347/103

FOREIGN PATENT DOCUMENTS

JP 2009-045851 A 3/2009
JP 2009-202515 A 9/2009

* cited by examiner

*Primary Examiner* — An Do
(74) *Attorney, Agent, or Firm* — Canon U.S.A. Inc., IP Division

(57) ABSTRACT

An image recording method includes a liquid composition-applying step in which a liquid composition is applied onto an intermediate transfer body, an intermediate-image-forming step in which an ink containing a colorant is applied onto the intermediate transfer body to form an intermediate image, and a transferring step in which the intermediate image is heated to a transfer temperature $T_t$ and transferred onto a recording medium. The liquid composition includes first polymer particles. The ink includes second polymer particles. In the transferring step, $Tg_2<T_t<Tg_1$, where $Tg_1$ denotes a glass transition point of the first polymer particles and $Tg_2$ denotes a glass transition point of the second polymer particles.

9 Claims, 1 Drawing Sheet

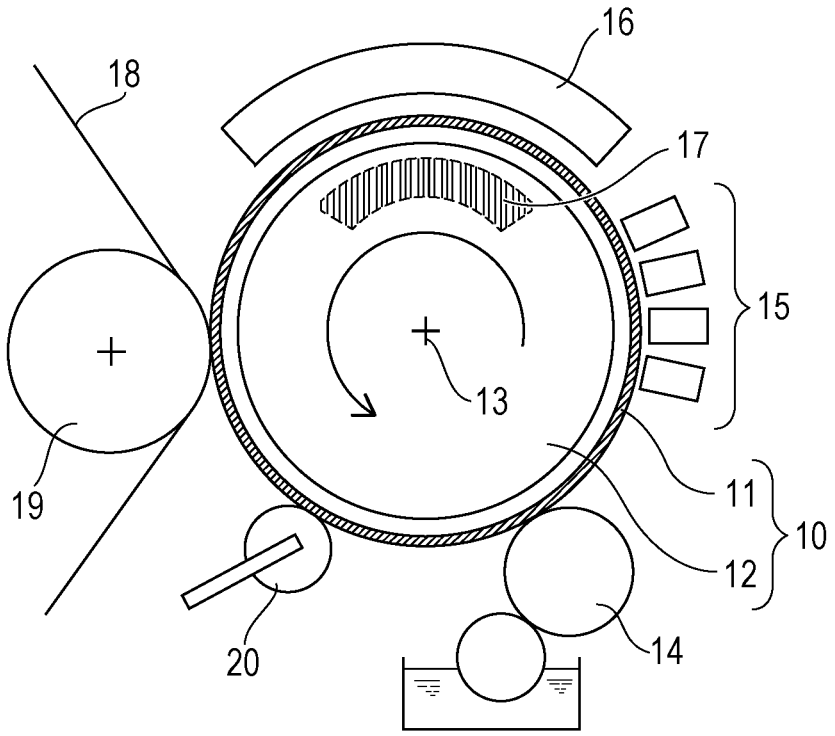
16
18
17
15
13
19
11
10
12
20
14

IMAGE RECORDING METHOD

BACKGROUND OF THE INVENTION

1. Field of the Invention

The present invention relates to an image recording method.

2. Description of the Related Art

An image recording method in which an ink is applied onto an intermediate transfer body to form an intermediate image and the intermediate image is transferred onto a recording medium (hereinafter, also referred to as "intermediate-transfer-type image-recording method") is known. Recently, there has been an increase in the demand for high-speed printing. Accordingly, an intermediate-transfer-type image-recording method with which a high-quality image can be formed even at a high transfer rate has been studied. In an intermediate-transfer-type image-recording method, the quality of a recorded image is greatly affected by the efficiency of transfer of an intermediate image from an intermediate transfer body to a recording medium.

In order to improve the transfer efficiency, there have been studies on an image recording method in which polymer particles are used (see Japanese Patent Laid-Open No. 2009-045851 and Japanese Patent Laid-Open No. 2009-202515, hereinafter, which are referred to as "PTL 1" and "PTL 2", respectively). PTL 1 discloses an image recording method in which an aqueous liquid composition including polymer particles having a glass transition point of 47° C. is applied onto an intermediate transfer body, a pigment ink including polymer particles having a glass transition point of 49° C. is applied onto the intermediate transfer body to form an intermediate image, and then the intermediate image is transferred onto a recording medium at a transfer temperature of 80° C., 120° C., or 180° C.

PTL 2 discloses an image recording method in which first polymer particles are applied onto an intermediate transfer body and subsequently second polymer particles having a lower softening temperature than the first polymer particles are applied onto the intermediate transfer body to form a multilayer body formed of two types of polymer particles on the intermediate transfer body, then an ink is applied onto the multilayer body to form an intermediate image, and the intermediate image is transferred onto a recording medium at a transfer temperature between the softening temperatures of the two types of polymer particles.

According to the studies conducted by the inventors of the present invention, the transfer efficiency was able to be improved by recording an image by the intermediate-transfer-type image-recording method described in PTLs 1 and 2. However, an image having a sufficient quality could not be obtained when it was recorded at a high transfer rate that has been anticipated in recent years.

Accordingly, the present invention provides an image recording method with which high transfer efficiency may be achieved.

SUMMARY OF THE INVENTION

An image recording method according to an embodiment of the present invention includes a liquid composition-applying step in which a liquid composition is applied onto an intermediate transfer body, an intermediate-image-forming step in which an ink containing a colorant is applied onto the intermediate transfer body to form an intermediate image, and a transferring step in which the intermediate image is heated to a transfer temperature $T_t$ and transferred onto a recording medium. The liquid composition includes first polymer particles. The ink includes second polymer particles. In the transferring step, $Tg_2<T_t<Tg_1$, where $Tg_1$ denotes a glass transition point of the first polymer particles and $Tg_2$ denotes a glass transition point of the second polymer particles.

Further features of the present invention will become apparent from the following description of exemplary embodiments with reference to the attached drawings.

BRIEF DESCRIPTION OF THE DRAWING

FIGURE is a schematic diagram illustrating an example of an image recording apparatus used in an image recording method according to an embodiment of the present invention.

DESCRIPTION OF THE EMBODIMENT

Hereafter, a preferred embodiment of the present invention is described in detail.

In order to realize a high transfer efficiency in an intermediate-transfer-type image-recording method, both of the following two properties are desirably achieved.

(1) low adhesion of an intermediate image to an intermediate transfer body; and (2) high adhesion of an intermediate image to a recording medium.

The inventors of the present invention have focused on polymer particles as a measure to control the adhesion of an intermediate image to an intermediate transfer body or to a recording medium. The adhesion of polymer particles to an object varies depending on the conditions of the polymer particles. Specifically, polymer particles become soft at a temperature higher than their glass transition point, which tends to increase the adhesion of the polymer particles to an object. On the other hand, polymer particles become hard at a temperature lower than their glass transition point, which tends to reduce the adhesion of the polymer particles to an object.

The inventors have conducted studies on a method with which the above-described properties (1) and (2) are achieved in a transferring step by utilizing the above properties of polymer particles and, as a result, devised a method of reducing the adhesion of an intermediate image to an intermediate transfer body at a certain transfer temperature by orienting polymer particles having a glass transition point higher than the transfer temperature toward a surface of the intermediate image on which the intermediate image is to be brought into contact with the intermediate transfer body as well as increasing the adhesion of the intermediate image to a recording medium by orienting polymer particles having a glass transition point lower than the transfer temperature toward a surface of the intermediate image on which the intermediate image is to be brought into contact with the recording medium. Specifically, the inventors have found that an intermediate image having the above-described properties (1) and (2) in a transferring step can be formed by a method in which a liquid composition including polymer particles (first polymer particles) having a glass transition point higher than the transfer temperature is applied onto an intermediate transfer body and subsequently an ink including polymer particles (second polymer particles) having a glass transition point lower than the transfer temperature is applied onto the resulting intermediate transfer body.

In an embodiment of the present invention, the difference ($T_t-Tg_2$) between the transfer temperature $T_t$ in a transferring step and the glass transition point $Tg_2$ of the second polymer particles is preferably 10° C. or more. When $T_t-Tg_2$ is 10° C. or more, the above-described property (2) is enhanced, which improves the transfer efficiency. The difference ($Tg_1-T_t$ between the glass transition point $Tg_1$ of the first polymer particles and the transfer temperature $T_t$ in a transferring step is preferably 10° C. or more. When $Tg_1-T_t$ is 10° C. or more, the above-described property (1) is enhanced, which increases the transfer efficiency.

Image Recording Method

An image recording method according to an embodiment of the present invention includes a liquid composition-applying step in which a liquid composition is applied onto an intermediate transfer body, an intermediate-image-forming step in which an ink containing a colorant is applied onto the intermediate transfer body to form an intermediate image, and a transferring step in which the intermediate image is heated to a transfer temperature and transferred onto a recording medium.

In the liquid composition-applying step, the liquid composition may be applied onto the intermediate transfer body by, for example, an ink jet method or a coating method such as roller coating, bar coating, or spray coating. In particular, a coating method may be used.

In the intermediate-image-forming step, the ink may be applied onto the intermediate transfer body by an ink jet method. Specifically, a method of ejecting an ink from an ejection orifice of a recording head by the action of thermal energy to the ink may be employed.

In the transferring step, an intermediate image recorded on the intermediate transfer body is brought into contact with a recording medium and then transferred from the intermediate transfer body onto the recording medium at a certain transfer temperature. Thus, an image is recorded on the recording medium. Examples of the recording medium used in this embodiment broadly include cloth, plastic, and film in addition to paper used for general printing. The recording medium used in the image recording method according to the embodiment may be cut into a desired size prior to recording of an image thereon or may be used in the form of a roll sheet and cut into a desired size subsequent to the recording of an image. The term "transfer temperature" herein refers to a temperature at which an intermediate image is transferred. An intermediate image may be heated to a predetermined transfer temperature by, for example, heating a roller to the predetermined transfer temperature in advance or by installing an additional heater.

The transfer temperature may be set appropriately depending on the type of polymer particles used so that the conditions according to the embodiment, that is, $Tg_2<T_t<Tg_1$, are satisfied, where $T_t$ denotes the transfer temperature in the transferring step, $Tg_1$ denotes the glass transition point of the first polymer particles, and $Tg_2$ denotes the glass transition point of the second polymer particles. The transfer temperature is preferably 25° C. or more and 160° C. or less, more preferably 30° C. or more and 100° C. or less, and further preferably 40° C. or more and 80° C. or less.

When being transferred onto a recording medium, an intermediate image may be pressed by a pressure roller or the like from both the intermediate-transfer-body side and the recording-medium side. This improves the transfer efficiency. Pressing may be conducted step by step. Since there has recently been an increase in the demand for high-speed printing as described above, it has been anticipated that high transfer efficiency is attained even at a high transfer rate. Thus, in this embodiment, the transfer rate is preferably 0.2 m/sec or more and more preferably 1.0 m/sec or more.

The image recording method according to the embodiment may include, prior to the transferring step, a step of reducing the amount of liquid constituent that is excessively contained in a recorded intermediate image. The amount of liquid constituent may be reduced by any method used in the art. Specific examples of such a method include heating, blowing of low-humidity air, depressurizing, and a combination of two or more of these methods.

The image recording method according to the embodiment may include, subsequent to the transferring step, a step of pressing the recording medium on which an image has been transferred with a roller or the like. This increases the smoothness of the image. The roller may be heated before being used for pressing the recording medium on which an image has been transferred. Pressing with a heated roller enhances the fastness of the image.

The image recording method according to the embodiment may include, subsequent to the transferring step, a step of cleaning the surface of the intermediate transfer body. The surface of the intermediate transfer body may be cleaned by any method used in the art. Examples of such a method include showering the intermediate transfer body with a cleaning liquid, wiping off a residue by abutting a wet dampening roller on the intermediate transfer body, bringing the intermediate transfer body into contact with a cleaning liquid, wiping off a residue on the intermediate transfer body with a wiper blade, applying various types of energy to the intermediate transfer body, and a combination of two or more of these methods.

FIGURE is a schematic diagram illustrating an example of an image recording apparatus used in the image recording method according to the embodiment. In the image recording apparatus shown in FIGURE, an intermediate transfer body 10 includes a rotatable cylindrical support member 12 and a surface-layer member 11 disposed on the outer peripheral surface of the support member 12. The surface-layer member 11 is a layer composed of, for example, silicone rubber and PET sheet. The surface-layer member 11 is fixed on the outer peripheral surface of the support member 12 with double-sided sticky tape or the like. The intermediate transfer body 10 (support member 12) rotates around a rotating shaft 13 in the direction of the arrow (counterclockwise) shown in FIGURE. Other components around the periphery of the intermediate transfer body 10 are configured to operate in synchronization with the rotation of the intermediate transfer body 10. In the step of applying the liquid composition onto the intermediate transfer body, the liquid composition may be applied onto the intermediate transfer body 10 with a coating roller 14 or the like. The ink is provided by an ink jet recording head 15 or the like and thereby an intermediate image, which is a mirror image of a desired image, is recorded on the intermediate transfer body 10. In order to reduce the amount of liquid constituent that is excessively contained in the intermediate image, the image recording apparatus may optionally include an air blower 16 and a heater 17. Subsequently, a recording medium 18 and the intermediate transfer body 10 are brought into contact with each other using a pressure roller 19 heated to a predetermined transfer temperature, and thereby the intermediate image is transferred to the recording medium 18. In order to clean the surface of the intermediate transfer body, the image recording apparatus may optionally include a cleaning unit 20.

Liquid Composition

The liquid composition used in the image recording method according to the embodiment includes the first polymer particles.

First Polymer Particles

The term "polymer particles" used herein refers to particles of a polymer dispersed in an ink in a form such that each dispersed particle has a certain diameter. In this embodiment, the arithmetic average particle diameter of the first polymer particles is preferably 200 nm or less and is more preferably 10 nm or more and 100 nm or less. In Examples described below, the average particle diameter of polymer particles was measured with Laser Diffraction/Scattering Particle Size Distribution Analyzer LA-920 (produced by HORIBA, Ltd.). In order to measure particle diameter, the liquid composition was diluted so that the volume density of the polymer particles reaches 0.1%.

The average particle diameter of the first polymer particles is preferably 0.2 times or more and 5 times or less the average particle diameter of the second polymer particles described below. In this case, the first polymer particles and the second polymer particles are less likely to be mixed with each other on the intermediate transfer body and, as a result, a layer to which the first polymer particles are oriented and a layer to which the second polymer particles are oriented are likely to be each separately formed. This allows the advantages of the image recording method according to the embodiment to be achieved with efficiency.

The glass transition point of the first polymer particles is preferably 80° C. or more. When the glass transition point of the first polymer particles is 80° C. or more, melting of the polymer particles is suppressed even in a high-temperature environment such as in an automobile dashboard, that is, enhanced high-temperature durability of a recorded image may be produced. The glass transition point of the first polymer particles is more preferably 100° C. or more and is further preferably 160° C. or less. In this embodiment, the glass transition point of polymer particles is measured by a method conforming to JIS K 7121. In Examples described below, the glass transition point of polymer particles was measured with a differential scanning calorimeter (produced by PerkinElmer Japan Co., Ltd.). In this embodiment, in the case where the polymer particles have a plurality of glass transition points, the lowest temperature is considered as the glass transition point.

The polystyrene-equivalent weight-average molecular weight of the first polymer particles determined by gel permeation chromatography (GPC) is preferably 1,000 or more and 2,000,000 or less.

In this embodiment, the content (mass %) of the first polymer particles in the liquid composition is preferably 1% by mass or more of the total mass of the liquid composition. If the content of the first polymer particles is less than 1% by mass, the transfer efficiency may fail to be improved to a sufficient degree. The content (mass %) of the first polymer particles in the liquid composition is preferably 50% by mass or less of the total mass of the liquid composition. If the content of the first polymer particles is more than 50% by mass, the first polymer particles may precipitate disadvantageously. More preferably, the content of the first polymer particles in the liquid composition is 2% by mass or more and 40% by mass or less.

In this embodiment, the first polymer particles may be prepared from any known polymer. Specific examples of polymers that may be particularly suitably used include polyolefin, polystyrene, polyurethane, polyester, polyether, polyurea, polyamide, poly(vinyl alcohol), polymethacrylic acid and its salt, poly(alkyl methacrylate), and polydiene. These polymers may be a monopolymer or a copolymer and may be used alone or in combination of two or more as needed.

Reaction Agent

In this embodiment, the liquid composition may include a reaction agent that causes a constituent of the ink to aggregate or precipitate. For example, the reaction agent in the liquid composition may cause a colorant contained in the ink to aggregate or precipitate. Specifically, when the colorant is a dye, the reaction agent may cause the dye dissolved in the ink to precipitate. When the colorant is a pigment, the reaction agent may cause the pigment dispersed in the ink to aggregate. The reaction agent in the liquid composition may cause the second polymer particles contained in the ink to aggregate. The aggregation or precipitation of a constituent of the ink, which is caused by the reaction agent, results in an increase in the viscosity of the ink, which allows an intermediate image to be readily held on the intermediate transfer body.

Examples of the reaction agent include polyvalent metal ions and an organic acid. In this embodiment, the reaction agent may be an organic acid because of its high rate of reaction with the colorant contained in the ink.

Examples of the polyvalent metal ions include divalent metal ions such as $Ca^{2+}$, $Cu^{2+}$, $Ni^{2+}$, $Mg^{2+}$, and $Zn^{2+}$; and trivalent metal ions such as $Fe^{3+}$ and $Al^{3+}$. These compounds may be used alone or in combination of two or more. These polyvalent metal ions may be added to the liquid composition in the form of a salt. Examples of ions that form a salt with the polyvalent metal ions include $Cl^-$, $NO_3^-$, $SO_4^{2-}$, $I^-$, $Br^-$, $ClO_3^-$, and $RCOO^-$ (where R represents an alkyl group having a carbon number of 1 to 20). The content of the polyvalent metal ions is preferably 5.0% by mass or more and 70.0% by mass or less of the total mass of the liquid composition.

Any known organic acid may be suitably used. Specific examples thereof include organic carboxylic acids and organic sulfonic acids. Specifically, such a organic acid may be selected from polyacrylic acid, acetic acid, methanesulfonic acid, glycol acid, malonic acid, malic acid, maleic acid, ascorbic acid, succinic acid, glutaric acid, fumaric acid, citric acid, tartaric acid, lactic acid, sulfonic acid, levulinic acid, orthophosphoric acid, pyrrolidone carboxylic acid, pyrone carboxylic acid, pyrrole carboxylic acid, furan carboxylic acid, pyridine carboxylic acid, coumarinic acid, thiophene carboxylic acid, nicotinic acid, derivatives of these compounds, salts of these compounds, and the like. In particular, levulinic acid, which is less likely to precipitate in the liquid composition, may be used from the viewpoint of the preservation stability of the liquid composition. These compounds may be used alone or in combination of two or more. The content of the organic acid is preferably 5.0% by mass or more and 90.0% by mass or less of the total mass of the liquid composition. When an organic acid is used as the reaction agent, the pH of the liquid composition is preferably 4.0 or less, is more preferably 1.0 or more and 3.5 or less, and is further preferably 1.0 or more and 3.0 or less.

Aqueous Medium

In this embodiment, the liquid composition may include an aqueous medium that is water or a mixed solvent of water and a water-soluble organic solvent. The content (mass %) of the water-soluble organic solvent in the liquid composition is preferably 3.0% by mass or more and 50.0% by mass or less of the total mass of the liquid composition. Any known water-soluble organic solvent may be used. Examples thereof include alcohols, glycols, alkylene glycols having an alkylene group with a carbon number of 2 to 6, polyethylene glycols, nitrogen-containing compounds, and sulfur-containing compounds. These water-soluble organic solvents may be used alone or in combination of two or more as needed. Deionized water (ion-exchange water) may be used as water. The content (mass %) of water in the liquid composition is preferably 50.0% by mass or more and 95.0% by mass or less of the total mass of the liquid composition.

Other Constituents

In this embodiment, as needed, the liquid composition may further include a water-soluble organic compound that is solid at a normal temperature, such as a polyalcohol (e.g., trimethylolpropane and trimethylolethane), urea, or a urea derivative (e.g., ethyleneurea). In this embodiment, as needed, the liquid composition may further include various additives such as a surfactant, a pH adjuster, an anticorrosive, a preservative, an antifungal agent, an antioxidant, a reducing inhibitor, an evaporation promoter, a chelating agent, and a polymer other than the polymer used for preparing the first polymer particles. In particular, the liquid composition may include a polymer such as poly(vinyl alcohol) or polyvinylpyrrolidone in order to improve the rubbing fastness of a recorded image.

Ink

The ink used in the image recording method according to the embodiment includes the second polymer particles and a colorant.

Second Polymer Particles

The arithmetic average particle diameter of the second polymer particles is preferably 5 nm or more and 350 nm or less, is more preferably 10 nm or more and 250 nm or less, and is further preferably 50 nm or more and 100 nm or less. The arithmetic average particle diameter of the second polymer particles may be calculated by the same method as that used to calculate the arithmetic average particle diameter of the first polymer particles. The glass transition point of the second polymer particles is preferably 30° C. or more and 110° C. or less. The polystyrene-equivalent weight-average molecular weight of the second polymer particles determined by GPC is preferably 1,000 or more and 2,000,000 or less.

In this embodiment, the content (mass %) of the second polymer particles in the ink is preferably 1% by mass or more of the total mass of the ink. If the content of the second polymer particles is less than 1% by mass, the transfer efficiency may fail to be enhanced to a sufficient degree. The content (mass %) of the second polymer particles in the ink is preferably 50% by mass or less of the total mass of the ink. If the content of the second polymer particles is more than 50% by mass, the second polymer particles may precipitate disadvantageously. The content of the second polymer particles is more preferably 2% by mass or more and 40% by mass or less.

Preferably, the content (mass %) of the second polymer particles in the ink is equal to or more than and is 10 times or less the content (mass %) of the colorant described above based on the total mass of the ink. If the content of the second polymer particles is smaller than the content of the colorant, the second polymer particles may fail to produce an effect of bonding the particles of the colorant to one another to a sufficient degree and, as a result, the transfer efficiency may fail to be enhanced to a sufficient degree. If the content of the second polymer particles is larger than 10 times the content of the colorant, a sufficient vividness of a recorded image may fail to be produced since the content of the second polymer particles is excessively larger than that of the colorant.

In this embodiment, the second polymer particles may be prepared from any know polymer. Specific examples of polymers that may be particularly suitably used include polyolefin, polystyrene, polyurethane, polyester, polyether, polyurea, polyamide, poly(vinyl alcohol), polymethacrylic acid and its salt, poly(alkyl methacrylate), and polydiene. These polymers may be a monopolymer or a copolymer and may be used alone or in combination of two or more as needed.

Colorant

In this embodiment, examples of the colorant include a pigment and a dye. Any known pigment and dye may be used. In this embodiment, a pigment may be used from the viewpoint of the water fastness of a recorded image. The content (mass %) of the colorant is preferably 0.1% by mass or more and 15.0% by mass or less and is more preferably 1.0% by mass or more and 10.0% by mass or less of the total mass of the ink.

In this embodiment, when a pigment is used as the colorant, the pigment may be dispersed using a polymer as a dispersant (polymer dispersion-type pigments, such as polymer dispersion pigment prepared using a polymer dispersant, microencapsulated pigment prepared by coating the surfaces of pigment particles with a polymer, and polymer-bonded pigment including an organic group containing a polymer chemically bonded to the surfaces of pigment particles) or by introducing a hydrophilic group on the surfaces of pigment particles (self-dispersion-type pigments, i.e., self-dispersion pigments). Needless to say that pigments prepared by different dispersion methods may be used in combination with one another. Specifically, carbon black and an organic pigment may be used as a pigment. These pigments may be used alone or in combination with two or more. When the pigment used for preparing the ink is the polymer-dispersion-type pigment, a polymer is used as a dispersant. The polymer used as the dispersant may include both a hydrophilic portion and a hydrophobic portion. Specific examples of such a polymer include acrylic polymers prepared by polymerization of monomers having a carboxyl group, such as acrylic acid and methacrylic acid; and urethane polymers prepared by polymerization of diols having an anionic group, such as dimethylolpropionic acid. The acid value of the polymer used as a dispersant is preferably 50 mgKOH/g or more and 550 mgKOH/g or less. The polystyrene-equivalent weight-average molecular weight (Mw) of the polymer used as a dispersant determined by GPC is preferably 1,000 or more and 15,000 or less. The content (mass %) of the polymer dispersant in the ink is preferably 0.1% by mass or more and 10.0% by mass or less and is more preferably 0.2% by mass or more and 4.0% by mass or less of the total mass of the ink. The content (mass %) of the polymer dispersant is preferably 0.1 times or more and 3.0 times or less the content (mass %) of the pigment.

Aqueous Medium

In this embodiment, the ink may include an aqueous medium that is water or a mixed solvent of water and a water-soluble organic solvent. The content (mass %) of the water-soluble organic solvent in the ink is preferably 3.0% by mass or more and 50.0% by mass or less of the total mass of the ink. Any known water-soluble organic solvent may be used. Examples thereof include alcohols, glycols, alkylene glycols having an alkylene group with a carbon number of 2 to 6, polyethylene glycols, nitrogen-containing compounds, and sulfur-containing compounds. These water-soluble organic solvents may be used alone or in combination of two or more as needed. Deionized water (ion-exchange water) may be used as water. The content (mass %) of water in the ink is preferably 50.0% by mass or more and 95.0% by mass or less of the total mass of the ink.

Other Constituents

In this embodiment, as needed, the ink may further include a water-soluble organic compound that is solid at a normal temperature, such as a polyalcohol (e.g., trimethylolpropane and trimethylolethane), urea, or a urea derivative (e.g., ethyleneurea). In this embodiment, as needed, the ink may further include various additives such as a surfactant, a pH adjuster, an anticorrosive, a preservative, an antifungal agent, an antioxidant, a reducing inhibitor, an evaporation promoter, a chelating agent, and a polymer other than the polymer used for preparing the second polymer particles. In particular, the ink may include a polymer such as poly(vinyl alcohol) or polyvinylpyrrolidone in order to improve the rubbing fastness of a recorded image.

EXAMPLES

The present invention is further described below in detail with reference to Examples and Comparative Examples. However, the invention is not limited to these examples and various modifications may be made thereto without departing from the scope of the present invention. The "part" in Examples and Comparative Examples are on a mass basis unless otherwise noted.

Preparation of Pigment Dispersion

Preparation of Pigment Dispersion A

MONARCH 1100 carbon black (produced by Cabot Corporation) was dispersed in NIKKOL BC15 (polyoxyethylene cetyl ether, produced by Nikko Chemicals Co., Ltd.) to prepare a pigment dispersion A having a pigment content of 10% by mass.

Preparation of Pigment Dispersion B

MONARCH 1100 carbon black (produced by Cabot Corporation) was dispersed in styrene-ethyl acrylate-acrylic acid copolymer (acid value: 150 mgKOH/g, weight-average molecular weight: 8,000) that was neutralized with an aqueous potassium hydroxide solution. Thus, a pigment dispersion B having a pigment content of 10% by mass was prepared.

Preparation of Pigment Dispersion C

Cab-O-Jet200 (produced by Cabot Corporation), which was a self-dispersion carbon black including a sulfophenyl group bonded to the surfaces of the carbon black particles, was diluted with water and thoroughly stirred to prepare a pigment dispersion C having a pigment content of 10% by mass.

Preparation of Polymer Particle Dispersions

Preparation of Polymer Particle Dispersion 1

Polymerization of ethyl methacrylate monomer was performed using Nikkol BC15 (produced by Nikko Chemicals Co., Ltd.) as a dispersant. Thus, a polymer particle dispersion 1 (polymer content: 20.0% by mass) having an average particle diameter of 100 nm and a glass transition point of 65° C. was prepared.

Preparation of Polymer Particle Dispersions 2 to 7

Polymerization of butyl methacrylate monomer, ethyl methacrylate monomer, methyl methacrylate monomer, or any two of the three monomers was performed by changing copolymerization ratio, polymerization time, and the like. Thus, a polymer particle dispersion (polymer content: 20.0% by mass) having the arithmetic average particle diameter and the glass transition point shown in Table 1 was prepared.

TABLE 1

Physical properties of polymer particle dispersions

| Polymer particle dispersion No. | Glass transition point Tg (° C.) | Arithmetic average particle diameter d (nm) |
|---|---|---|
| Polymer particle dispersion 1 | 60 | 30 |
| Polymer particle dispersion 2 | 105 | 10 |
| Polymer particle dispersion 3 | 105 | 20 |
| Polymer particle dispersion 4 | 105 | 100 |
| Polymer particle dispersion 5 | 80 | 30 |
| Polymer particle dispersion 6 | 65 | 100 |

TABLE 1-continued

Physical properties of polymer particle dispersions

| Polymer particle dispersion No. | Glass transition point Tg (° C.) | Arithmetic average particle diameter d (nm) |
|---|---|---|
| Polymer particle dispersion 7 | 65 | 20 |
| Polymer particle dispersion 8 | 65 | 10 |

Preparation of Inks

The pigment dispersions and the polymer particle dispersions prepared above were each mixed with the following constituents as shown in Table 2.

| | |
|---|---|
| Pigment dispersion (pigment content: 10.0% by mass) | 20.0% by mass |
| Polymer particle dispersion (polymer content: 20.0% by mass) | 25.0% by mass |
| Glycerin | 10.0% by mass |
| Diethylene glycol | 4.0% by mass |
| Acetylenol E100 (surfactant, produced by Kawaken Fine Chemicals Co., Ltd.) | 1.0% by mass |
| Ion-exchange water | 40.0% by mass |

The resulting mixture of above constituents was thoroughly stirred to form a dispersion. Subsequently, the dispersion was filtered under pressure through a micro filter (produced by FUJIFILM Corporation) having a pore size of 3.0 μm. Thus, inks were prepared.

TABLE 2

Conditions for preparing inks

| | Pigment | Polymer particle dispersion | | |
|---|---|---|---|---|
| Ink No. | dispersion Pigment dispersion No. | Polymer particle dispersion No. | $Tg_2$ of polymer particles (° C.) | Arithmetic average particle diameter $d_2$ of polymer particles (nm) |
| Ink 1 | Pigment dispersion A | Polymer particle dispersion 1 | 60 | 30 |
| Ink 2 | Pigment dispersion B | Polymer particle dispersion 1 | 60 | 30 |
| Ink 3 | Pigment dispersion A | Polymer particle dispersion 5 | 80 | 30 |
| Ink 4 | Pigment dispersion B | Polymer particle dispersion 5 | 80 | 30 |
| Ink 5 | Pigment dispersion C | Polymer particle dispersion 1 | 60 | 30 |
| Ink 6 | Pigment dispersion A | Polymer particle dispersion 7 | 65 | 20 |
| Ink 7 | Pigment dispersion A | Polymer particle dispersion 6 | 65 | 100 |
| Ink 8 | Pigment dispersion B | Polymer particle dispersion 6 | 65 | 100 |
| Ink 9 | Pigment dispersion A | Polymer particle dispersion 8 | 65 | 10 |

Preparation of Liquid Compositions

The polymer particle dispersions were each mixed with the following constituents as shown in Table 3.

| | |
|---|---|
| Polymer particle dispersion (polymer content: 20.0% by mass) | 30.0% by mass |
| Reaction agent | 30.0% by mass |
| Acetylenol E100 (surfactant, produced by Kawaken Fine Chemicals Co., Ltd.) | 1.0% by mass |
| Ion-exchange water | 39.0% by mass |

The resulting mixture of above constituents was thoroughly stirred and subsequently filtered under pressure through a micro filter (produced by FUJIFILM Corporation) having a pore size of 3.0 μm. Thus, liquid compositions were prepared.

TABLE 4

Combinations of inks and liquid compositions

| | Liquid composition | | | Ink | | | | | | |
|---|---|---|---|---|---|---|---|---|---|---|
| Example No. | Liquid composition No. | $Tg_1$ of polymer particles (° C.) | Arithmetic average particle diameter $d_1$ of polymer particles (nm) | Ink No. | $Tg_2$ of polymer particles (° C.) | Arithmetic average particle diameter $d_2$ of polymer particles (nm) | Transfer temperature $T_t$ (° C.) | $T_t - Tg_2$ (° C.) | $Tg_1 - T_t$ (° C.) | Ratio between average particle diameters ($d_1/d_2$) |
| Example 1 | Liquid composition 1 | 105 | 100 | Ink 1 | 60 | 30 | 70 | 10 | 35 | 3.3 |
| Example 2 | Liquid composition 1 | 105 | 100 | Ink 2 | 60 | 30 | 100 | 40 | 5 | 3.3 |
| Example 3 | Liquid composition 1 | 105 | 100 | Ink 3 | 80 | 30 | 100 | 20 | 5 | 3.3 |
| Example 4 | Liquid composition 1 | 105 | 100 | Ink 6 | 65 | 20 | 70 | 5 | 35 | 5.0 |
| Example 5 | Liquid composition 3 | 105 | 20 | Ink 7 | 65 | 100 | 70 | 5 | 35 | 0.2 |
| Example 6 | Liquid composition 4 | 105 | 10 | Ink 8 | 65 | 100 | 70 | 5 | 35 | 0.1 |
| Example 7 | Liquid composition 1 | 105 | 100 | Ink 9 | 65 | 10 | 70 | 5 | 35 | 10.0 |
| Example 8 | Liquid composition 2 | 80 | 30 | Ink 5 | 60 | 30 | 70 | 10 | 10 | 1.0 |
| Comparative Example 1 | Liquid composition 1 | 105 | 100 | Ink 4 | 80 | 30 | 70 | −10 | 35 | 3.3 |
| Comparative Example 2 | Liquid composition 2 | 80 | 30 | Ink 5 | 60 | 30 | 100 | 40 | −20 | 1.0 |

TABLE 3

Conditions for preparing liquid compositions

| | Polymer particle dispersion | | |
|---|---|---|---|
| Liquid composition No. | Polymer particle dispersion No. | $Tg_1$ of polymer particles (° C.) | Arithmetic average particle diameter $d_1$ of polymer particles (nm) |
| Liquid composition 1 | Polymer particle dispersion 4 | 105 | 100 |
| Liquid composition 2 | Polymer particle dispersion 5 | 80 | 30 |
| Liquid composition 3 | Polymer particle dispersion 3 | 105 | 20 |
| Liquid composition 4 | Polymer particle dispersion 2 | 105 | 10 |

Evaluations

An ink cartridge was filled with the ink prepared above and then attached to an image recording apparatus having the structure shown in FIGURE. The liquid composition prepared above was applied onto an intermediate transfer body with a coating roller. The ink was ejected from an ink jet recording head onto the intermediate transfer body including the liquid composition applied thereon to record an intermediate image (2 cm×2 cm solid image) with a recording duty of 100%. In this image recording apparatus, a condition of applying eight 3.5-nanogram ink droplets onto a unit region of 1/600 inches×1/600 inches at a resolution of 600 dpi×600 dpi was defined as a recording duty of 100%. Subsequently, the intermediate image was transferred onto a recording medium "OK Prince Wood-Free Paper" (produced by Oji Paper Co., Ltd.) at a transfer rate of 1.0 m/sec with a pressure roller heated to the predetermined transfer temperature shown in Table 4.

Transfer Efficiency Evaluation

The proportion of a portion of the intermediate image remaining on the intermediate transfer body after the transferring step, that is, a transfer residual ratio (%) was calculated. Specifically, the transfer residual ratio was calculated by capturing the surface of the intermediate transfer body removed from the image recording apparatus as an image and then calculating the proportion of the area of a portion of the intermediate image that was not transferred and remained on the intermediate transfer body to the entire area of the recorded intermediate image. The transfer efficiency was evaluated on the basis of the transfer residual ratio in accordance with the following evaluation criteria. In the following evaluation criteria, A and B were considered to be acceptable levels, and C was considered to be an unacceptable level. Table 5 shows the evaluation results.

A: The transfer residual ratio was 1% or less, and the transfer efficiency was high.

B: The transfer residual ratio was more than 1% and 3% or less, the transfer efficiency was a little high.

C: The transfer residual ratio was more than 3%, and the transfer efficiency was low.

Evaluation of High-Temperature Durability of Images

On the recording medium prepared above, on which an image was recorded, a recording medium "OK Prince Wood-Free Paper" (produced by Oji Paper Co., Ltd.) on which an image was not recorded was superimposed. These recording media were left to stand for 1 hour while being pressurized at 1 kg/cm$^2$ in an oven kept at 80° C. Subsequently, the superimposed recording medium on which an image was not recorded was peeled off in the oven kept at 80° C. Then, the proportion of the area of a portion of the image that was not transferred to the removed recording medium and remained to the entire area of the initially recorded image was calculated. The high-temperature durability of an image was evaluated on the basis of this proportion in accordance with the following evaluation criteria. Table 5 shows the evaluation results.

A: The proportion of the area of a remaining portion of the image was 99% or more, and the high-temperature durability was high.

B: The proportion of the area of a remaining portion of the image was 97% or more and less than 99%, and the high-temperature durability was a little high.

TABLE 5

| Evaluation results | | |
|---|---|---|
| | Evaluation results | |
| Example No. | Transfer efficiency | High-temperature durability of images |
| Example 1 | A | A |
| Example 2 | B | A |
| Example 3 | B | A |
| Example 4 | B | A |
| Example 5 | B | A |
| Example 6 | B | B |
| Example 7 | B | B |
| Example 8 | A | A |
| Comparative Example 1 | C | A |
| Comparative Example 2 | C | B |

According to the above-described embodiment of the present invention, an image recording method with which high transfer efficiency may be achieved is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-041964, filed Mar. 4, 2013, which is hereby incorporated by reference herein in its entirety.

What is claimed is:

1. An image recording method comprising:

a liquid composition-applying step in which a liquid composition is applied onto an intermediate transfer body;

an intermediate-image-forming step in which an ink containing a colorant is applied onto the intermediate transfer body to form an intermediate image; and a transferring step in which the intermediate image is heated to a transfer temperature $T_t$ and transferred onto a recording medium, wherein the liquid composition includes first polymer particles, wherein the ink includes second polymer particles, and wherein, in the transferring step, $Tg_2<T_t<Tg_1$, where $Tg_1$ denotes a glass transition point of the first polymer particles and $Tg_2$ denotes a glass transition point of the second polymer particles.

2. The image recording method according to claim 1, wherein a difference $(T_t-Tg_2)$ between the transfer temperature $T_t$ and the glass transition point $Tg_2$ of the second polymer particles is 10° C. or more, and wherein a difference $(Tg_1-T_t)$ between the glass transition point $Tg_1$ of the first polymer particles and the transfer temperature $T_t$ is 10° C. or more.

3. The image recording method according to claim 1, wherein an arithmetic average particle diameter of the first polymer particles is 0.2 times or more and 5 times or less an arithmetic average particle diameter of the second polymer particles.

4. The image recording method according to claim 1, wherein the glass transition point of the first polymer particles is 80° C. or more.

5. The image recording method according to claim 1, wherein a content (mass %) of the second polymer particles in the ink is equal to or more than and is 10 times or less a content (mass %) of the colorant based on the total mass of the ink.

6. The image recording method according to claim 1, wherein the liquid composition further includes a reaction agent, and wherein the second polymer particles in the ink is aggregated by the reaction agent.

7. The image recording method according to claim 6, wherein the colorant in the ink is aggregated or precipitated by the reaction agent.

8. The image recording method according to claim 1, wherein after the liquid composition-applying step, the intermediate-image-forming step is performed.

9. The image recording method according to claim 1, wherein in the intermediate-image-forming step, the ink is applied on an area of the intermediate transfer body where the liquid composition is applied.

* * * * *